US005352021A

United States Patent [19]

Kunczynski

[11] Patent Number: 5,352,021

[45] Date of Patent: Oct. 4, 1994

[54] SEAT ASSEMBLY FOR CHAIRLIFT

[75] Inventor: Jan K. Kunczynski, Glenbrook, Nev.

[73] Assignees: Zygmunt Alexander Kunczynski; Alexander Jan Kunczynski, both of Carson City, Nev.

[21] Appl. No.: 782,583

[22] Filed: Oct. 25, 1991

[51] Int. Cl.[5] ..... A47C 7/02

[52] U.S. Cl. ..... 297/452.1; 297/284.2; 297/440.11

[58] Field of Search ..... 297/452, 218, 219, 226, 297/441, 440, 284.2

[56] References Cited

U.S. PATENT DOCUMENTS

| | | | |
|---|---|---|---|
| 2,692,010 | 10/1954 | Christie | 297/284.2 |
| 3,512,834 | 5/1970 | Lockshin | 297/441 |
| 3,706,473 | 12/1972 | Mullen | 297/440 X |

FOREIGN PATENT DOCUMENTS

| | | | |
|---|---|---|---|
| 330594 | 8/1989 | European Pat. Off. | 297/440 |
| 2304306 | 10/1976 | France | 297/440 |
| 7315518 | 11/1973 | Netherlands | 297/440 |
| 132153 | 7/1951 | Sweden | 297/284.2 |
| 184201 | 8/1922 | United Kingdom | 297/441 |
| 806110 | 12/1958 | United Kingdom | 297/440 |

*Primary Examiner*—Lauriel K. Cranmer
*Attorney, Agent, or Firm*—Flehr, Hohbach, Test, Albritton & Herbert

[57] ABSTRACT

A seat assembly (22) for a chairlift or the like in which there is a transversely-extending hollow extruded body (31, 32, 33, 61, 62) having a length dimension sufficient to support a passenger thereon. A pair of side assemblies (34, 63) are mounted to opposite ends of the extruded hollow body, and an elongated transversely-extending securement rod (46, 47, 64) is coupled to both the side members (34, 63) and extends through the hollow body to sandwich the sides against the intermediate hollow body and secure the body members (31, 32, 33, 61, 62) together as a unit. The same system is used for forming the seat (23), as well as the seat back (24). Cushion attachment and tensioning recesses (81, 86, 91, 96) or pockets are provided in the extruded seat and seat back bodies which allow capture of enlarged edges (84, 88, 92, 98) of seat cushion material (85, 89) to effect attachment and tensioning.

18 Claims, 4 Drawing Sheets

SEAT ASSEMBLY FOR CHAIRLIFT

TECHNICAL FIELD

The present invention relates, in general, to seat assemblies which are used on chairlifts or other passenger conveying aerial tramways, and more particularly, relates to an apparatus and method for construction the chairlift seat assembly and attaching cushioning material thereto.

BACKGROUND ART

In the aerial tramway industry, and particularly in connection with chairlifts, bench-type seat assemblies are widely employed. These seats have heretofore been formed by tubular frame members with metal sheets or panels secured to the frame members. Cushion material is mounted over the panels. Typically, both the seat and seat back are formed by mounting an aluminum panels over tubing and thereafter securing various types of cushioning material to the panels. In some instances fiberglass or other non-metallic panels are mounted to the tubing.

The chairlift seat cushions are secured to the seat assemblies in a variety of manners, including screw-type fasteners, rivets and even bungee-cord assemblies, which stretch the cushioning over the seat and seat back.

The construction of chairlift seat assemblies, accordingly, is somewhat tedious and costly. Moreover, the adverse weather conditions, high passenger use and passenger abuse of the seat assemblies cause the cushioning material to have to be replaced frequently. Still further, while the front side of the chairlift seat has a clean appearance, the back and underneath sides of prior art chairlift chairs, which are conventionally seen by skiers, often have a very cluttered and unappealing appearance with sharp and sometimes dangerous edges and fasteners.

Accordingly, it is an object of the present invention to provide a chairlift seat assembly method for forming the same which overcomes the above-noted deficiencies in prior art seat assemblies.

It is a further object of the present invention to provide a chairlift seating assembly which is durable, is high in strength, has cushion material which is easily attached and has a desirable appearance from all sides.

DISCLOSURE OF INVENTION

The seat assembly for a chairlift of the present invention comprises, briefly, a transversely-extending seat body formed to support at least one passenger while seated thereon, a pair of side assemblies with one side assembly mounted in engagement with each end of the seat body, and an elongated securement member coupled to each of the side assemblies and extending therebetween and urging the side assemblies toward each other and against the seat body to secure the side assemblies and seat body together as a unit. In the preferred form the seat body is provided by a plurality of hollow extruded metallic members mounted in side-by-side relation and received in a recess or groove in the side assemblies. The securement member is provided by a transversely-extending tension rod having at least one threaded end which can be adjusted axially to compressibly load the extruded seat body between the side members. The same type of construction is used for the seat back.

In another aspect of the invention the extruded seat body and back include recesses formed to receive enlarged edges of cushion material to enable mounting and tensioning of the cushion material over the seat body.

BEST MODE OF CARRYING OUT THE INVENTION

Figure 1:
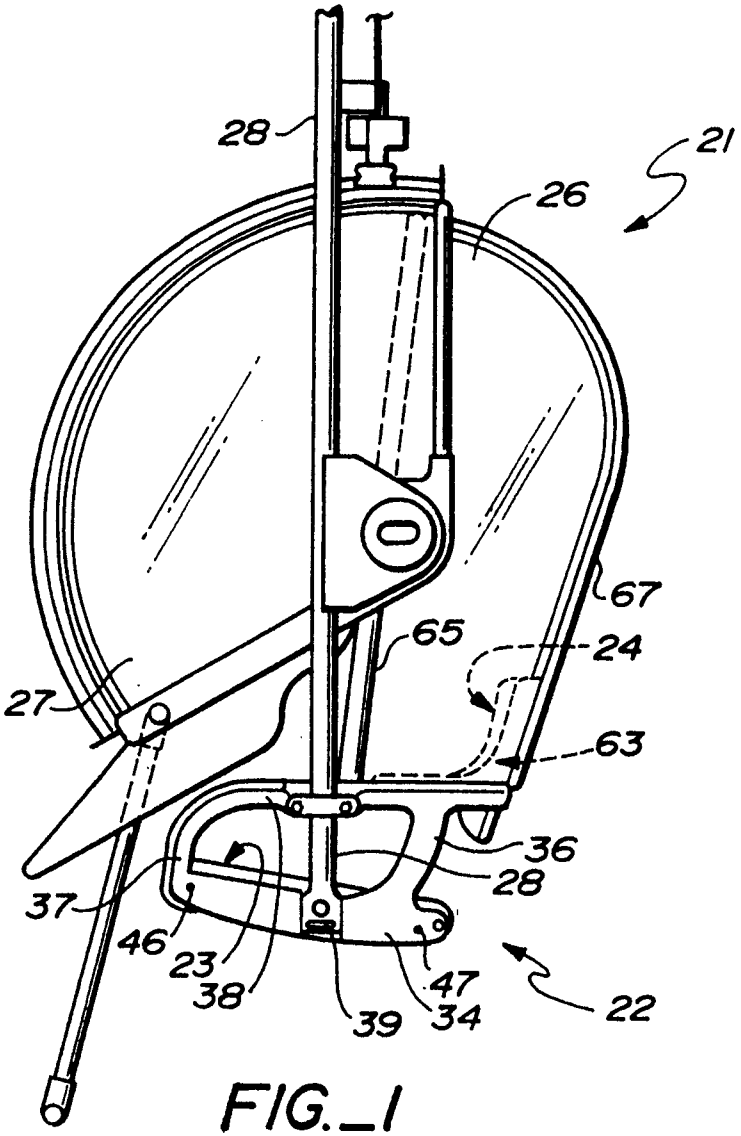
FIG. 1 is a side-elevation view of a chairlift chair having a seat assembly constructed in accordance with the present invention.
Figure 2:
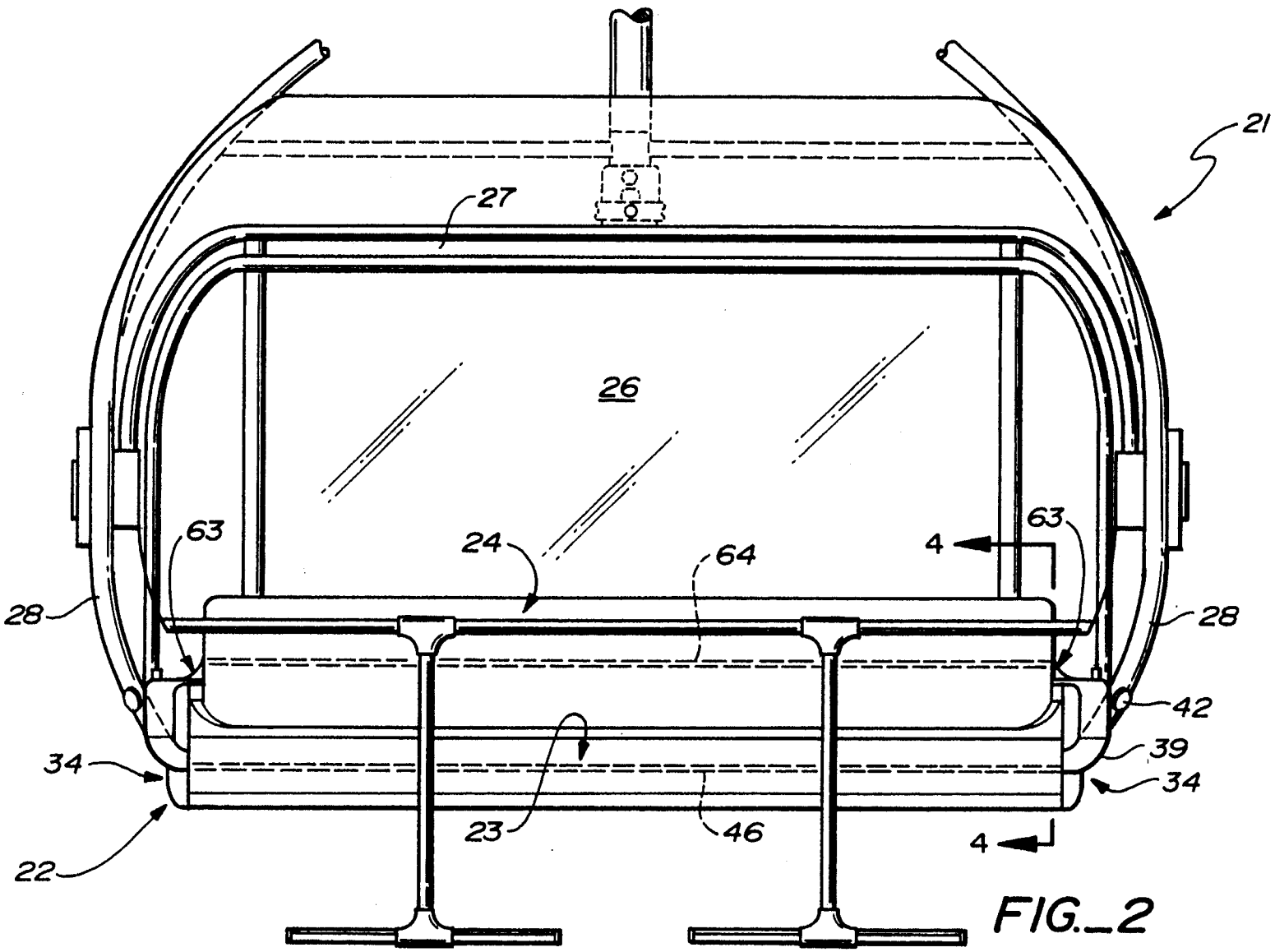
FIG. 2 is a front-elevation view of the chairlift chair of FIG. 1.

FIGS. 1 and 2 illustrate a chairlift chair assembly, generally designated 21, which has a seat assembly, generally designated 22, including seat portion 23 and seat back 24. Although not forming of the present invention, the chairlift chair also includes an enclosure assembly comprised of a stationary enclosure shell 26 and a movable enclosure shell 27. Seat assembly 22 is mounted to a downwardly-depending hangar arm 28, which in turn is coupled, either permanently or releasably, to a haul rope (not shown).

Instead of the traditional tubular frame and panel-type of construction, however, seat assembly 22 of the present invention employs an almost modular approach which has extremely high strength and yet is easily assembled. The modular construction of seat assembly 22 of the present invention is applicable to both seat 23 and to seat back 24.

Figure 5:
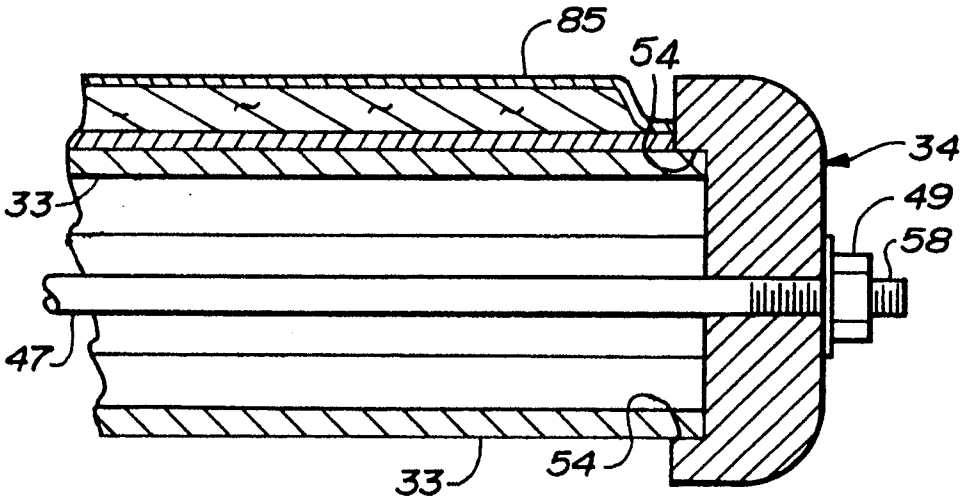
FIG. 5 is a fragmentary, cross-sectional view taken substantially along the plane of line 5—5 in FIG. 3.
Figure 3:
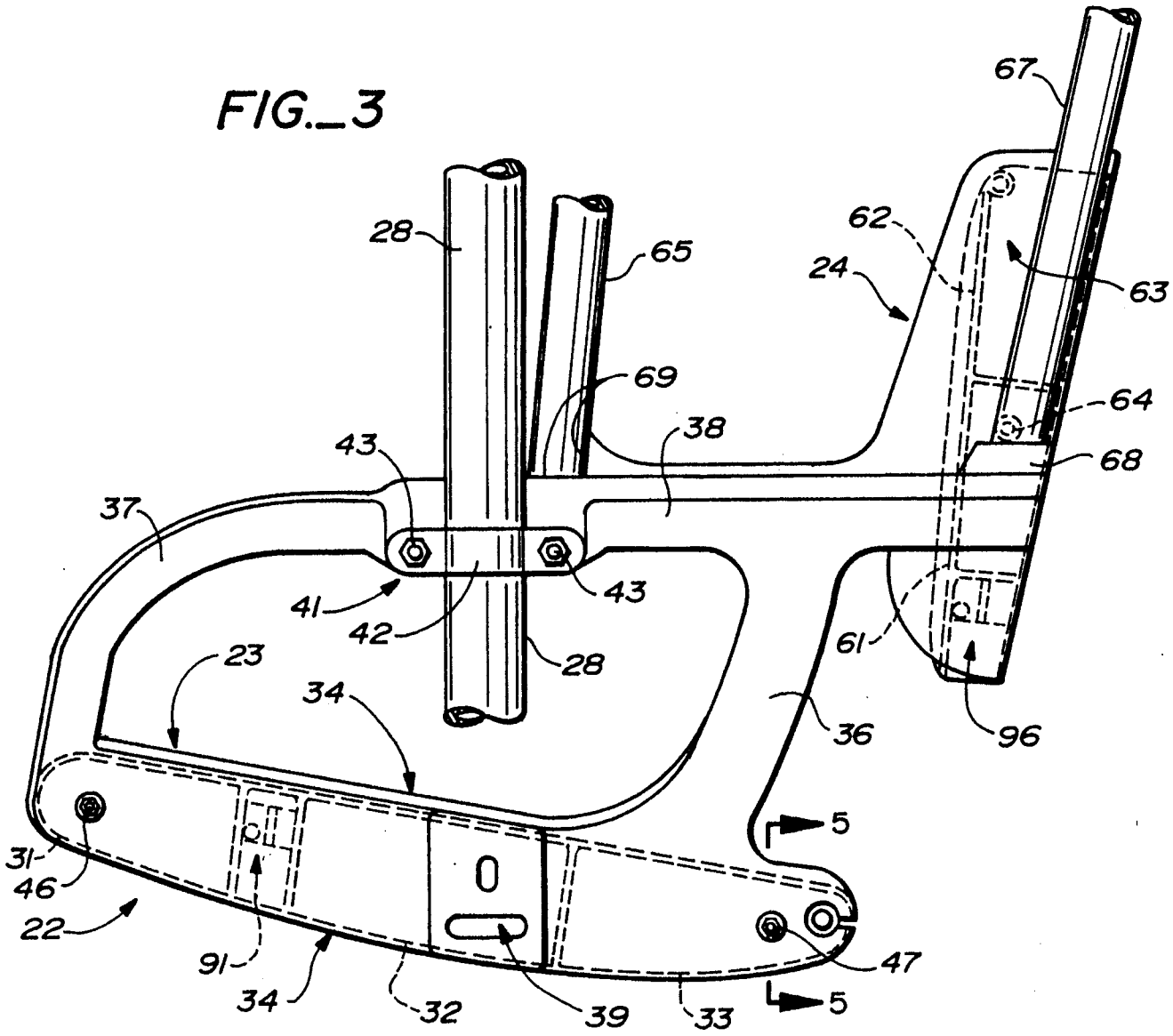
FIG. 3 is an enlarged, fragmentary, side-elevation view of the seat assembly of FIG. 1.
Figure 4:
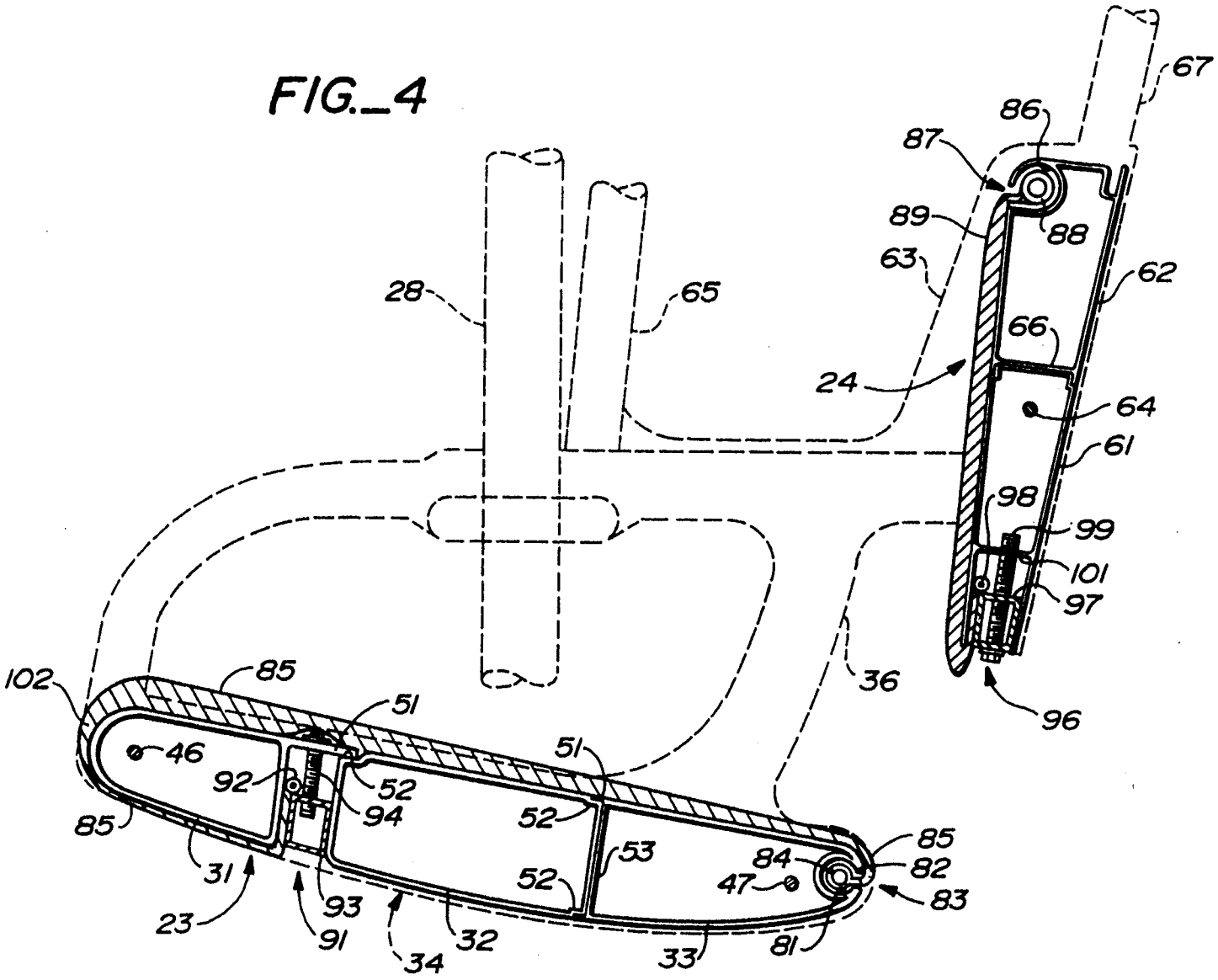
FIG. 4 is an enlarged, side elevation view, in cross-section, taken substantially along the plane of line 4—4 in FIG. 2.

Referring now to FIGS. 3, 4 and 5, seat assembly 22 can be seen to be constructed from a transversely-extending body, which is preferably hollow and preferably an extruded metal. Thus, for seat 23, there is a seat body formed from three hollow extruded body members 31, 32 and 33, and for seat back 24 there are two hollow extruded body members 61 and 62. Each hollow extruded body member 31–33 and 61,62 has a length which extends transversely across the chair assembly over a length dimension depending upon the number of people to set in the chair. Chair assembly 21, as illustrated in FIG. 2, is a quadchair in which each of the seat members 31–33 and 61,62 extends over a length sufficient to enable four people to sit on the chair at the same time.

Mounted at each end of transversely-extending seat body members 31, 32 and 33 are side assemblies 34, which preferably include integrally-formed, upwardly-extending side post 36 and front post 37 that support an arm rest portion 38 therebetween. End assemblies 34 also preferably have lower hanger arm mounting means 39 and upper hanger arm mounting means 41 to which a bracket 42 can be secured by fasteners 43 so as to couple the seat assembly to hangar arm 28.

End assemblies 34 and hollow body members 31, 32 and 33 are secured together as a unit by elongated securement means, preferably transversely-extending securement or tensioning rods 46 and 47. Tensioning rods 46 and 47 are thereby coupled to side assemblies 34, preferably passing therethrough and having a nut mounted to threaded ends of rods 46 and 47. The tensioning rods extend down the length of the front and rear seat body members 31 and 33. As best may be seen in FIG. 5, the ends of the securement rods are threaded at 48 to receive a nut 49 so that end assemblies can be drawn down against the seat body members. The side assemblies, in effect, sandwich the transversely-extending body members therebetween. This sandwiching and compression of the seat body members between the sides 34 ensures that the entire assembly is secured together as a rigid, high-strength unit.

In the most preferred form, each body member 31, 32 and 33 is a hollow extruded aluminum member. As will be seen in FIG. 4, adjacent extruded members can be formed with complementary flanges 51 which nest with recesses 52 in the next member. For the purpose of assembly, adhesive can be placed at the abutting interface 53 between members 32 and 33 which facilitates handling during assembly. Additionally, it is preferable that the end assemblies 34 be provided by metal castings and further that they include a recess, groove or lip 54 dimensioned to receive and nest with the periphery of the respective ends of transversely-extending seat body members 31, 32 and 33. Thus, each of the side assemblies 34 is pulled down by securement rod 47 until the lip 54 mates with the outside periphery of the body members. End assemblies 34, therefore, lock the seat body members together against relative vertical displacement. As will be understood, side assemblies 34 also could have a lip or projection (not shown) which extends into the interior of each of the hollow body members 31, 32 and 33, instead of lip 54 engaging the exterior. Alternatively, a groove can be cast into the interior surface of the side assembly members 34 so as to receive or engage both the inside and outside of the peripheral wall of the body members.

As can be seen from FIG. 4, body members 31–33 of seat assembly 23 have a large cross-sectional area and accordingly sectional modulus. When pulled together by rods 46 and 47 into an assembly, the strength of the seat assembly can be very substantial and easily suited to support four adults between the side assemblies without unacceptable deflection during static or dynamic loading. The sandwiching of tubular body portions between end assemblies, therefore, creates an extremely high strength platform for support of loads. The vertical walls in adjacent body members 31, 32 and 33 add to the overall resistance to deflection.

As above noted, seat back 24 preferably is constructed in the same manner as described in connection with seat 23. Thus, two transversely-extending, hollow, extruded aluminum, body members 61 and 62 are clamped between seat back side members 63 by an elongated securement bolt or rod 64. Again, the interface 66 between members 61 and 62 can be formed with mated nesting flanges and recesses and have an adhesive applied thereto to facilitate handling during assembly. The sandwich of seat back members also will be seen to have a high section modulus and very high strength, while still being hollow and relatively light in weight. Seat back side assemblies 63 can be cast with grooves, lips or recesses dimensioned to receive the peripheral edges of the seat members 61 and 62. Bolt or tensioning rod 64 will have threaded ends and is tensioned before the enclosure frame member 67 is mounted in socket 68 of seat back side assembly 63. An additional enclosure frame member 65, for the stationary enclosure 26, can be seen to be welded at 69 to seat back side assembly 63 and to seat side assembly 34.

In another aspect of the chairlift seat assembly of the present invention the seat and seat back are both formed with cushion attachment means, which preferably take the form of recesses provided in the extruded seat and backrest body members. For seat 23, a circular recess 81 is provided proximate rear edge 82 of the seat. The recess 81 includes a neck 83 dimensioned for sliding receipt of seat cushion sheet material therethrough. The seat cushion sheet material has an enlarged edge 84 which has a sufficient cross-sectional area to prevent the same from being pulled out through neck 83. A similar recess 86 with neck 87 formed to receive enlarged edge 88 of cushioning material 89 can be seen at the upper edge of seat back 24. Recesses 81 and 86 and the slots or necks 83 and 87 extend over the full transverse length of the seat and seat back bodies 33 and 62, respectively. In order to mount cushion material 85 and 89 to the seat and seat back, therefore, the cushion material must be provided with an enlarged edge. This can be done by mounting a dowel or rope or by folding the edge until it cannot pull out of the necks 83 and 87. Enlarged edges 84 and 86 must be threaded in to recesses 81 and 86 from the opened ends of the recesses in a manner similar to a mainsail on a sailboat. Once the enlarged edges of the cushioning material 85 and 89 have been threaded into recesses 81 and 86, the enlarged edges will trap the cushioning material in the recesses so that it cannot be pulled out by circumferential tension around the seat and seat back bodies.

Seat assembly 22 also includes means for securing the opposite end of cushioning material 85 and 89 and applying a circumferential tension force thereto. Thus, in seat assembly 23 a second recess 91 is provided in which a second enlarged edge 92 of seat cushion 85 is positioned. Securement of an edge 92 is accomplished by mounting a transversely-extending cushion retaining and tensioning member 93 in recess 91 so as to trap second enlarged edge 92. Fastener 94 threadably engages tensioning member 93 enabling the same to be pulled more deeply into recess 91. This causes the edge 92 to be drawn further into the recess and thereby effect circumferential tensioning of cushion 85 about the seat body.

Tensioning member 93 preferably is a hollow rectangular tube which extends the full transverse length of the seat, as does recess 91, so that edge 92 is trapped by tensioning member 93 over its full length. Fastener 94 can be positioned immediately proximate the side assemblies 34 so as to allow the edge of cushion 85 to be pulled or lifted back by an amount sufficient to expose fastener 94 for rotation of the same to apply the tensioning force. It has been found that using a fastener at each end of the tensioning member 93 is sufficient to effect tensioning of the cushion material over its full length.

In a similar manner the seat back is formed with a recess 96 in which tensioning member 97 is positioned to trapped enlarged edge 98 of back cushion 89. A fastening bolt 99, which threadably engages transverse wall 101, can be used to pull tensioning member 97 more deeply into recess 96 and thereby displace and tension back cushion 89.

As will be appreciated, a variety of different types of cushioning material can be attached to the seat assembly using the fastening system of the present invention.

Moreover, the cushioning material can be replaced as needed, and the cushion mounting system affords padding over the front edge 102 of the chair, which in some prior art seat assemblies has been relatively uncomfortable. As also will be seen from FIG. 4, the underneath side of seat 23 and the back of seat back 24 are relatively smooth and continuous surfaces, which have good visual appeal and enhanced safety. Instead of a plurality of pipes or frame members, bungee cords or the like, the seat and seat back assemblies of the present invention are aesthetically pleasing and tend to be free of any edges or attachments which can cause injury or snag objects along the path of the chairlift.

The method of forming a seat assembly for a chairlift of the present invention will be understood from the above description of the apparatus to include the steps of mounting an elongated securement or tensioning rod to extend between two side assemblies and through a hollow transversely-extending body. Additionally, the method includes applying a tensioning force to the securement means to draw the side assemblies into sufficiently nested engagement with the body to secure the side assemblies and body together as a unit.

In a second aspect of the method of the present invention a chairlift seat assembly is formed by sliding an enlarged edge of seat cushion material into a transversely-extending, open-ended first recess having a slotted neck dimensioned to prevent withdrawal of the edge therefrom. Thereafter the step of stretching the seat cushion away from the first recess and over a surface to be cushioned is performed, followed by mounting an opposite enlarged edge of the cushion material in a second recess spaced from the first recess. Finally, tensioning of the cushion is accomplished by pulling the cushion down tight over the surface to be cushioned by urging the opposite enlarged end further into the recess by a tensioning member and securing the opposite enlarged end in the recess after the pulling step.

What is claimed is:

1. A seat assembly for a chairlift comprising:

a transversely-extending hollow body having a length dimension and a width dimension sufficient to support a passenger thereon;

a pair of side assemblies with one side assembly mounted in engagement with each end of said hollow body, said side assemblies include arm rest means and means for securement of said seat assembly to a hanger arm; and elongated securement means extending transversely through said hollow body and coupled to both said side assemblies, said securement means urging said side assemblies toward each other and against said hollow body to secure said side assemblies to said hollow body as a unit with said side assemblies applying sufficient compressive force to said hollow body to support a passenger thereon without substantial deflection of said hollow body.

2. A method of forming a chairlift seat assembly comprising:

sliding an enlarged edge of seat cushion material into a transversely-extending open-ended first recess having a slotted neck dimensioned to prevent withdrawal of said enlarged edge therefrom by threading said enlarged edge into an open end of said first recess with said seat cushion material extending through said slotted neck and moving said seat cushion material in a direction parallel to said first recess;

stretching said seat cushion material away from said first recess over a surface to be cushioned;

mounting an opposite enlarged edge of said seat cushion material in a second recess spaced from said first recess;

pulling said seat cushion material down tight over said surface by urging said opposite enlarged edge farther into said second recess by adjusting a tensioning member; and securing said opposite enlarged edge in said second recess after said pulling step.

3. A seat assembly for a chairlift or the like comprising:

a transversely-extending seat body having a length dimension sufficient to support a passenger thereon;

a pair of side assemblies with one side assembly mounted in engagement with each end of said seat body, said side assemblies including arm rest means and means for securement of said seat assembly to a hanger arm;

elongated securement means extending transversely along said seat body and coupled to both said side assemblies, said securement means urging said side assemblies toward each other and against said seat body to secure said side assemblies to said seat body as a unit.

4. The seat assembly as defined in claim 3 wherein, said side assemblies include lip means projecting transversely to matingly engage ends of said seat body; and said securement means applies sufficient compressive force between said side assemblies to prevent displacement of said seat body relative to said lip means.

5. The seat assembly as defined in claim 3 wherein, said hollow body is formed from a extruded metallic body, and said side assemblies are formed with mating lips slidably receiving ends of said hollow extruded metallic body.

6. The seat assembly as defined in claim 5 wherein, said securement means is provided by at least one tension rod assembly extending form an outwardly facing side of each of said side assemblies and extending through the length of said seat body.

7. The seat assembly as defined in claim 5 wherein, said hollow extruded metallic body is a seat back body, and said securement means is provided by at least one tension rod assembly extending from an outwardly facing side of each of said side assemblies and extending through the length of said seat back body.

8. The seat assembly as defined in claim 3 wherein, said hollow body includes cushion attachment recess means.

9. The seat assembly as defined in claim 8 wherein, said cushion attachment recess means includes two transversely-extending recesses formed to extend over said length dimension of said seat body, said recesses each being formed to receive an enlarged edge of a cushion therein.

10. The seat assembly as defined in claim 9 wherein, at least one of said recesses is formed to receive a cushion tensioning assembly therein.

11. The seat assembly as defined in claim 10 wherein, said cushion tensioning assembly is a transversely-extending tensioning member and fastener means threadably coupled to said seat body, said recess being formed for displacement of said tensioning member in a direction tensioning said cushion.

12. The seat assembly as defined in claim 9 wherein, one of said recesses is positioned proximate a transversely-extending edge of said seat body and said seat body is formed to define a transversely-extending slot dimensioned to receive a sheet of cushion material therein and dimensioned to prevent withdrawal of said enlarged edge therefrom.

13. The seat assembly as defined in claim 3 wherein, said hollow body is formed a plurality of extruded members secured in side-by-side abutting relation by said side assemblies and said securement means.

14. The seat assembly as defined in claim 3 wherein, said seat body is formed with a smooth substantially continuous surface between front and rear edges thereof.

15. A seat assembly for a chairlift comprising:

a transversely-extending hollow body having a length dimension and a width dimension sufficient to support a passenger thereon, and including cushion attachment means having two transversely-extending recesses formed to extend over said length dimension of said hollow body, said recesses each being formed to receive an enlarged edge of a cushion therein;

a pair of side assemblies with one side assembly mounted in engagement with each end of said hollow body; and elongated securement means extending transversely through said hollow body and coupled to both said side assemblies, said securement means urging said side assemblies toward each other and against said hollow body to secure said side assemblies to said hollow body as a unit with said side assemblies applying sufficient compressive force to said hollow body to support a passenger thereon without substantial deflection of said hollow body.

16. The seat assembly as defined in claim 15 wherein, at least one of said recess is formed to receive a cushion tensioning assembly therein.

17. The seat assembly as defined in claim 16 wherein, said cushion tensioning assembly is a transversely-extending tensioning member and fastener means threadably coupled to said hollow body, said recess being formed for displacement of said tensioning member in a direction tensioning said cushion.

18. The seat assembly as defined in claim 15 wherein, one of said recesses is positioned proximate a transversely-extending edge of said hollow body and said hollow body is formed to define a transversely-extending slot dimensioned to receive a sheet of cushion material therein and dimensioned to prevent withdrawal of said enlarged edge therefrom.

* * * * *